US006058847A

United States Patent [19]

Adams

[11] Patent Number: 6,058,847

[45] Date of Patent: May 9, 2000

[54] SUBMERSIBLE MINE NEUTRALISATION VEHICLE

[75] Inventor: Richard Adams, Hampshire, United Kingdom

[73] Assignee: GEC-Marconi Limited, Middlesex, United Kingdom

[21] Appl. No.: 09/029,236

[22] PCT Filed: Sep. 5, 1996

[86] PCT No.: PCT/GB96/02187

§ 371 Date: Jul. 10, 1998

§ 102(e) Date: Jul. 10, 1998

[87] PCT Pub. No.: WO97/10992

PCT Pub. Date: Mar. 27, 1997

[30] Foreign Application Priority Data

Sep. 21, 1995 [GB] United Kingdom ..... 9519252

[51] Int. Cl.[7] ..... B63G 9/00; F42B 7/02; F42B 19/00; B64D 1/04

[52] U.S. Cl. ..... 102/402; 102/403; 89/1.13; 114/20.1; 114/20.2

[58] Field of Search ..... 102/402, 403; 89/1.13; 114/20.1, 20.2, 20.3, 21.1, 21.2, 21.3, 22, 23

[56] References Cited

U.S. PATENT DOCUMENTS

| | | | |
|---|---|---|---|
| 2,873,710 | 2/1959 | Morel | 114/330 |
| 3,250,238 | 5/1966 | Reder | 114/280 |
| 3,356,150 | 12/1967 | Ruszczycky et al. | 114/23 |
| 3,521,589 | 7/1970 | Kemp | 114/330 |
| 3,880,103 | 4/1975 | Talkington . | |
| 3,995,574 | 12/1976 | Drimmer | 114/20.1 |
| 5,078,069 | 1/1992 | August et al. | 114/20.1 |
| 5,277,117 | 1/1994 | Bender et al. | 102/402 |
| 5,505,155 | 4/1996 | Adams | 114/338 |
| 5,598,152 | 1/1997 | Scarzello et al. | 102/402 |
| 5,708,232 | 1/1998 | Nedderman, Jr. | 114/23 |
| 5,844,159 | 12/1998 | Posseme et al. | 89/1.13 |

FOREIGN PATENT DOCUMENTS

| | | |
|---|---|---|
| 38 26 653 | 12/1989 | Germany . |
| 38 20 183 | 2/1990 | Germany . |
| 2 149 066 | 6/1985 | United Kingdom . |
| 2 161 907 | 1/1986 | United Kingdom . |
| 2 281 538 | 3/1995 | United Kingdom . |

*Primary Examiner*—Theresa M. Wesson
*Attorney, Agent, or Firm*—Donald C. Casey

[57] ABSTRACT

A mine neutralisation vehicle comprises a first portion to which propulsion units are attached by which propulsion units the vehicle is positioned. Pivotally connected to the first section is a second section containing a shaped charge warhead. By means of the pivot connection the shaped charge can be directed at a mine, for example a buried mine, while the main body of the vehicle is maintained in a horizontal direction.

5 Claims, 2 Drawing Sheets

1
2
3
4
5
6
7
8
9
10
11
12
13
A 2
3
4
6
8
9
11
12
14
15
16
A

SUBMERSIBLE MINE NEUTRALISATION VEHICLE

This invention relates to an expendable "one shot" submersible mine neutralisation vehicle and particularly to such a vehicle employing a shaped charge.

In attempting to dispose of underwater mines it has been usual to place an explosive charge adjacent the mine and then detonate the explosive charge hoping that this will cause sympathetic detonation of the mine's warhead, destroying the mine, or at least render the mine's sensor and triggering mechanisms inoperative, rendering the mine harmless. Placement of such charges has been carried out by a human diver or by a remote controlled submersible.

Both of these methods have drawbacks. The main drawback is the high risk to the diver or submersible and it is in fact due to the unacceptably high risk to the diver that submersibles are used. However the very high cost of a submersible able to carry an explosive charge to a mine location, deploy the charge adjacent the mine, and return to the mother ship makes loss of the submersible unacceptable, in addition the weight and bulk of the submersible is such that only a very limited number can be stowed aboard a warship and as a result the vehicle's mine sweeping capability could rapidly be lost due to destruction of the submersibles. A further disadvantage is that the time taken to dispose of a mine is by these conventional methods is quite long due to the need to get the diver or submersible to a safe distance before detonating the charge and the need for the diver or submersible to return to the mother ship, which must always remain at a safe distance from the mine throughout the operation, to pick up further explosive charges. Since the combined explosive effect of the mine warhead and the disposal charge may be very great the safe distance is relatively large.

It has been proposed to overcome these drawbacks by employing an expendable remotely controlled submersible containing an explosive charge and simply moving the submersible into close proximity to a mine and detonating the charge, destroying the submersible and hopefully detonating the mine warhead or disabling the mine sensor and detonation mechanisms simultaneously. The bulk and expense of such an expendable submersible can be very much less than that of a conventional reusable submersible since there is no need to include any explosive charge deployment mechanism, the range and operational life need only be sufficient for a one way trip to the target mine and all of the control and power systems can be "one shot" devices.

UK Patent Application Publication Number GB 2281538 discloses such a "one shot" mine neutralisation vehicle which can both cruise towards a mine and hover in close proximity to a mine.

The embodiments disclosed in this earlier application are adequate for carrying a warhead into close proximity to a mine to be destroyed, where detonation of the warhead in close proximity to the mine destroys the mine by a sympathetic detonation occurring within the mine. However, some mines now employ new explosive materials such as plastics explosive which are not susceptible to sympathetic detonation. In order to destroy such mines it is desirable to be able to accurately position a shaped charge adjacent the mine such that the blast from the shaped charge is focused within the mine to be destroyed. Another advantage of using a directional shaped charge is that if used against a conventional mine a smaller charge can be used than would be required to ensure a sympathetic detonation, and therefore the size of the vehicle carrying the charge can be reduced. This results in a cheaper mine neutralisation vehicle and also enables more vehicles to be carried by mine clearance vessels. It may also enable the vehicle to be small enough to be deployed from a helicopter.

In order to correctly position a shaped charge relative to a mine to be exploded, it is necessary not only to pilot the vehicle into close proximity to the mine but also to be able to fully control the manoeuvrability of that vehicle when it reaches the mine.

Co-pending applications which correspond to PCT/GB96/02185, filed Sep. 5, 1996, and PCT/GB96/02186, filed Spe. 5, 1996, disclose propulsion systems for such a vehicle to enable it to be manoeuvred while substantially in a hover position so that a shaped charge is directed at the mine to be destroyed, however in certain scenarios it may still not be possible to satisfactorily align the charge relative to the mine.

According to the present invention there is provided a submersible mine neutralisation vehicle comprising a substantially cylindrical body having a first section comprising propulsion means for the vehicle and a second housing a warhead, the first and second section being connected such that the second section can be angled relative to the major axis of the first section.

Employing the present invention enables a warhead to be directed at a mine even when the main body of the vehicle cannot be directed "nose-on" to the mine. Such a situation may arise when the mine is substantially buried in the seabed such that the warhead has to be directed downwards, or when a current is flowings either over a buried mine or a tethered mine and the vehicle has to be driven against the current to maintain its position relative to the mine to be destroyed.

Preferably the second section of the vehicle body is pivotally connected to the first section and pivots about an axis passing through the centre of gravity of the second section. This ensures the action of pivoting the second section relative to the first does not destabilize the position of the second section on which the propulsion means are mounted, the vehicle preferably comprising means for hovering in a horizontal plane such that it may maintain a stationary position relative to a nine.

In any arrangement it is advantageous if the warhead comprises a shaped charge as such charges are highly directional and if correctly positioned relative to a nine to be destroyed can achieve the same effect as a larger conventional charge.

One embodiment of the present invention will now be described, by way of example only, with reference to FIGS. 1 to 4 of the accompanying drawings, of which:

Figure 1:
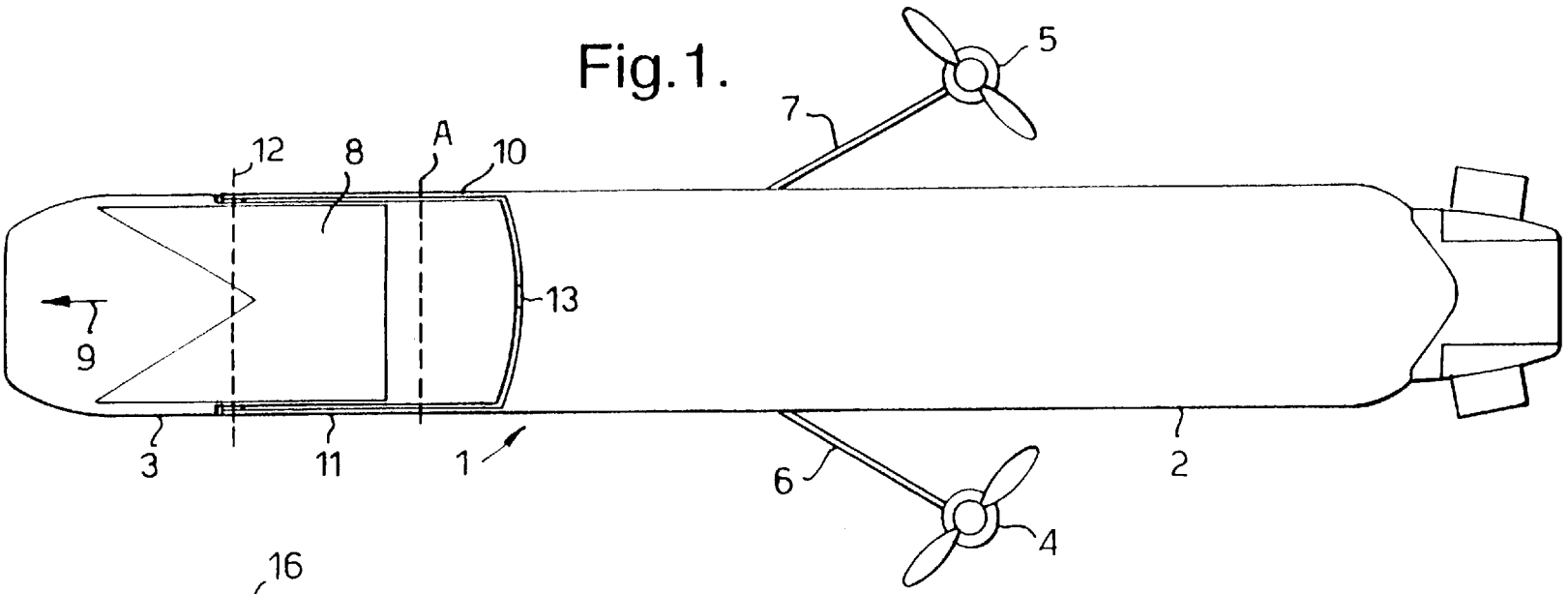
FIG. 1 is a plan view of the vehicle in accordance with the present invention with the second section in a "straight ahead" position.
Figure 2:
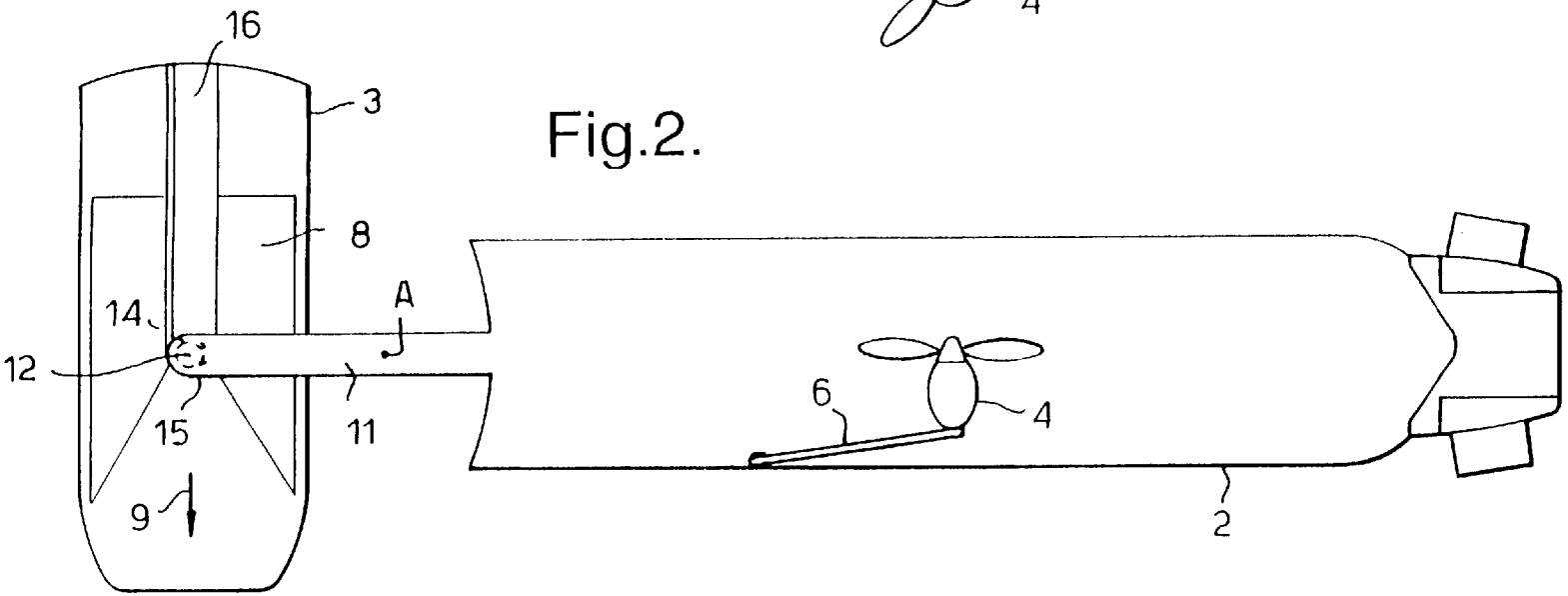
FIG. 2 is a side elevation of the vehicle of FIG. 1 with the second section in a downward facing position.

Referring to FIG. 1, a vehicle 1 in accordance with the present invention comprises a first section 2 and a second section 3, the first section having thruster units 4, 5 attached to it by arms 6. 7. The arms 6, 7 are connected to a shaft passing through the hull of the vehicle, which shaft can be rotated through 90° such that thrust units 4, 5 can either adopt a hover position as shown in FIGS. 1 and 2 or a forward thrust position as illustrated in FIGS. 3 and 4. The mechanism by which this is achieved is disclosed in UK Patent GB 2281538. The second section 3 encases a charge 8 which is shaped such that on detonation the explosive force is concentrated in the direction of arrow 9. The second section 3 can be pivoted on arms 10, 11 extending from the first section 2 about axis 12 to a position illustrated in FIG. 2, a side elevation of the vehicle of FIG. 1. The axis 12 about which the second section pivots passes through the centre of gravity of the second section such that the action of pivoting section 3 does not alter the position or orientation of the first section 2. This ensures that the stability of the vehicle is not upset due to the pivoting action.

When deployed from a mother ship the vehicle cruises to a position in close proximity to the mine to be destroyed with the first and second sections orientated as shown in FIG. 1. When it is determined that the correct position is reached the second section is pivoted by withdrawing pin 13 which locates in a detent in the back of the second section. The second section then rotates under the action of spring 14 until the arms 10, 11 come into contact with the end face 15 of a cutaway portion 16 of section 3. It will be appreciated that if for any specific application it is desirable to have complete control of the relative position of the first and second sections then a mechanical actuator could be employed by which the second section could then be pivoted to any position relative to the first section. Also if roll stability is a problem then if the warhead second section 3 is pivoted about axis "A" aft of the centre of gravity of the warhead then this will lower the centre of gravity when the warhead is angled, stabilising the vehicle when in a "firing" position.

Figure 3A:
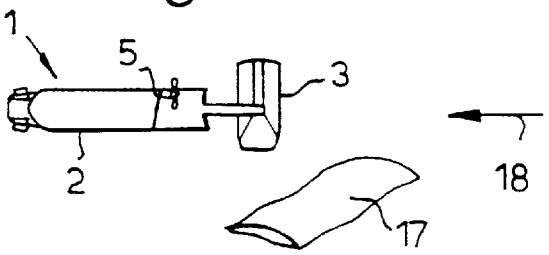
FIGS. 3A, 3B and 4 schematically illustrate applications to which a vehicle in accordance with the present invention is particularly applicable.
Figure 3B:
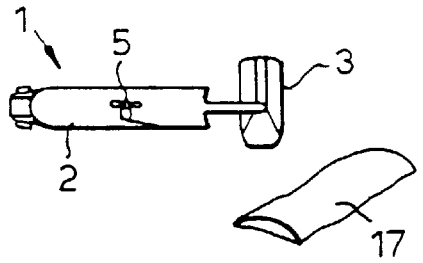
Figure 4:
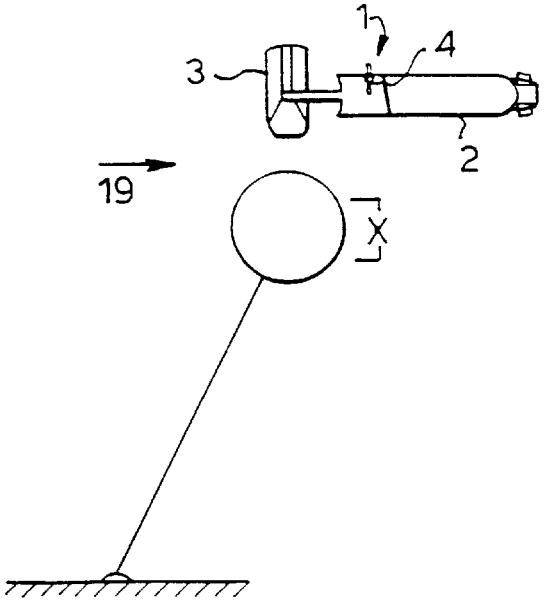

Referring to FIG. 3A there is illustrated one situation to which a vehicle in accordance with the present invention is particularly suited. A shaped charge contained within the first section 2 is directed at a partially buried mine by the second section being pivoted such that the shaped charge faces in a downward direction. The first section 2 remains in a horizontal position with thrust unit 5 and corresponding unit 4 (not shown) maintaining the vehicle in position against a current indicated by arrow 18. In FIG. 3B there is illustrated the same situation when no current is flowing, with the thrust units 4, 5 maintaining the vehicle at a fixed depth.

In FIG. 4 there is schematically illustrated how the vehicle 1 can be used to position a shaped charge relative to a moored mine. In such a situation where a strong current is flowing, indicated by arrow 19, a direct approach to the mine in the region marked "X" is not always possible due to turbulence. The present invention enables the vehicle 1 to correctly direct the shaped charge at the mine whilst remaining in the relatively cleanly flowing stream of water above the mine.

If the position of the second section relative to the first section is to be controlled by an actuator such that it can be positioned at angles other than at right angles to the first section then if the vehicle is to be deployed in this position in a current then a compensating fin will need to be positioned either on the first section or the second section to compensate for the force exerted on the slanted face of the second section.

The present invention has been described above with reference to one embodiment only. It will be apparent to one skilled in the art that various embodiments of the present invention are possible within the scope of the appended claims.

I claim:

1. A submersible mine neutralisation vehicle comprising a substantially cylindrical body having a first section comprising propulsion means for the vehicle and a second section housing a warhead, characterized in that in use the first and second sections are connected such that the second sections are connected such that the second section can be angled relative to the major axis of the first section without significantly altering the orientation of the first section.

2. A vehicle as claimed in claim 1 wherein the second section is pivotally connected to the first section and pivots about an axis passing through the centre of gravity of the second section.

3. A vehicle as claimed in claim 1 wherein the warhead comprises a shaped charge.

4. A vehicle as claimed in claim 3 wherein the second section is pivoted such that the warhead is downwardly directed.

5. A vehicle as claimed in claim 1 comprising means for hovering in a horizontal plane.

* * * * *